US005964301A

United States Patent [19]

Glasgow

[11] Patent Number: 5,964,301

[45] Date of Patent: Oct. 12, 1999

[54] TILTING LOADER BUCKET MECHANISM

[76] Inventor: Kenny Ern Glasgow, P.O. Box 252, Lytton, British Columbia, Canada, V0K 1Z0

[21] Appl. No.: 09/132,426

[22] Filed: Aug. 12, 1998

[51] Int. Cl.[6] ..... E02F 3/76

[52] U.S. Cl. ..... 172/811; 172/681

[58] Field of Search ..... 172/810, 811, 172/681

[56] References Cited

U.S. PATENT DOCUMENTS

| | | | |
|---|---|---|---|
| 3,419,171 | 12/1968 | Isaksen . | |
| 3,515,298 | 6/1970 | Guinot . | |
| 3,521,782 | 7/1970 | Peterson et al. . | |
| 3,556,330 | 1/1971 | Keskitalo et al. . | |
| 3,772,825 | 11/1973 | Gagnon | 172/811 X |
| 3,871,538 | 3/1975 | Miller et al. . | |
| 3,956,835 | 5/1976 | Evenson | 172/811 X |
| 4,042,131 | 8/1977 | Buttke . | |
| 4,098,350 | 7/1978 | Eftefield | 172/811 X |
| 4,167,979 | 9/1979 | Freese et al. | 172/811 X |
| 4,185,698 | 1/1980 | Frisbee | 172/811 X |
| 4,265,319 | 5/1981 | Seaberg | 172/811 |
| 4,274,797 | 6/1981 | Coon . | |
| 4,286,674 | 9/1981 | Noble et al. | 172/811 |
| 4,464,852 | 8/1984 | Rice | 172/811 X |
| 4,478,289 | 10/1984 | Enix | 172/811 X |
| 4,650,393 | 3/1987 | Denda . | |
| 4,821,808 | 4/1989 | Gurries | 172/811 X |
| 4,906,161 | 3/1990 | Weyer . | |
| 5,141,288 | 8/1992 | Smith . | |
| 5,392,864 | 2/1995 | Lindenmuth | 172/811 |
| 5,628,130 | 5/1997 | Desrochers | 172/810 X |

FOREIGN PATENT DOCUMENTS

| | | |
|---|---|---|
| 1273434 | 7/1968 | Germany . |

*Primary Examiner*—Christopher J. Novosad
*Attorney, Agent, or Firm*—Oyen Wiggs Green & Mutala

[57] ABSTRACT

A bucket tilt mechanism that allows the lateral tilting of a loader bucket in addition to vertical tilting. The lateral tilting of the bucket is achieved by the actuation of one of two hydraulic cylinders, each of which are attached to a bucket bracket and one of two loader support arms. A pivotal connection between the bucket bracket and a bar extending transversely between the loader support arms, and a central linkage arm which is comprised of three sub-arms, enable the bucket to tilt laterally responsive to the actuation of the hydraulic cylinders about the pivotal connection.

9 Claims, 4 Drawing Sheets

TILTING LOADER BUCKET MECHANISM

TECHNICAL FIELD

This invention relates to loader buckets, and more particularly to a mechanism which allows a front-end loader bucket to be tilted laterally in addition to conventional vertical tilting.

BACKGROUND

Front-end loaders and similar heavy machinery have various mechanisms which allow a bucket attached to the loader arms of the loader to tilt up and down, or vertically. This allows soil or other material to be dug into by tilting the loader bucket downwardly, and scooped up for transport, by tilting the material-filled bucket upwardly. Dug-up material is then dumped by tilting the bucket downwardly again. Throughout this operation, the conventional bucket remains horizontal relative to the loader, and usually, to the ground.

In many working situations, however, the mere vertical tilting action of the bucket does not allow the most efficient digging and dumping of the dug-up material. In many instances, it would be beneficial to use the bucket tilted at an angle that is not coincident with that of the loader. Road angle grading and dumping materials to a location smaller in size than the width of the bucket are examples of particular situations where a side-tilting, or laterally tilting loader bucket would be desirable.

The general idea of providing a laterally tiltable or side-dumping loader bucket mechanism is known. Existing United States Patents which show such tilting bucket mechanisms include the following:

U.S. Pat. No. 3,556,330 to Keskitalo et al.

U.S. Pat. No. 5,141,288 to Smith

U.S. Pat. No. 4,906,161 to Weyer

U.S. Pat. No. 3,419,171 to Isaksen

U.S. Pat. No. 4,274,797 to Coon

U.S. Pat. No. 3,871,538 to Miller et al.

U.S. Pat. No. 4,042,131 to Buttke

Another tilting system is shown in German Document 1 273 434 to Ludowici.

Unfortunately, the mechanisms of all of the aforementioned prior art suffer from one or more disadvantages. For example, some devices incorporate mechanisms which, though appropriate for backhoe excavators, would be unworkable and incompatible with the more rigorous needs of a front-end loader machine. Weyer, Buttke, Coon and Miller et al. are such references.

Other devices suffer from the limitation that the side dumping is achieved by the release of a bracket assembly on the underside of the bucket coupled with a corresponding upward extension of a rod or cylinder causing the bucket to move from a horizontal position to a tilted position in one sudden movement. While such mechanisms may adequately allow for side dumping, they unfortunately are not well suited for precise excavations requiring varying bucket angles or angled road grading. Keskitalo and Isaksen are examples of such references.

Accordingly, it is the object of the present invention to overcome these deficiencies and provide a durable mechanism for use with a front-end loader which allows side-dumping, while also having the capability to selectively and gradually move the bucket from a generally horizontal position to a laterally tilted position, so that precise excavations and like functions can effectively be carried out at varying angles.

SUMMARY OF THE INVENTION

The bucket tilt mechanism of the present invention comprises a bucket which is pivotally connected to a bucket bracket. The bucket bracket is also pivotally connected to a first cross member, which is itself transverse to and connected to a pair of loader support arms. The bucket bracket may comprise a flat bar which extends substantially the width of the bucket and which has extensions extending perpendicular to the longitudinal axis of the flat bar and a clevis which is centrally located on the flat bar.

The bucket tilt mechanism further comprises a central arm, which is substantially parallel to the loader support arms. The central arm has means for rotating a portion of the central arm, which can be a first-sub arm. The means for rotating a portion of the central arm can comprise a universal joint. The central arm can further comprise a second sub-arm, which is pivotally connected to a second transverse cross member.

The bucket tilt mechanism further comprises means for pivotally linking the bucket to the central arm. These means can comprise first and second linkage members, each of the linkage members having first and second ends. The first end of the first linkage member is pivotally connected to the bucket and the second end of the first linkage member is pivotally connected to the first end of the second linkage member. The second end of the second linkage member is pivotally connected to the bucket bracket.

The bucket tilt mechanism further comprises a second transverse cross member which is pivotally connected to the central arm.

The bucket tilt mechanism further comprises means for actuating lateral tilting of the bucket. The means for actuating lateral tilting of the bucket may comprise a pair of opposed cylinders, each one of the cylinders being attached at a first end to the bucket bracket and at a second end to one of the loader support arms. The cylinders may attach to clevis of the bucket bracket.

BRIEF DESCRIPTION OF DRAWINGS

In the drawings which illustrate specific embodiments of the invention, but which should not be construed as restricting the spirit or scope of the invention in any way.

DESCRIPTION

Figure 1:
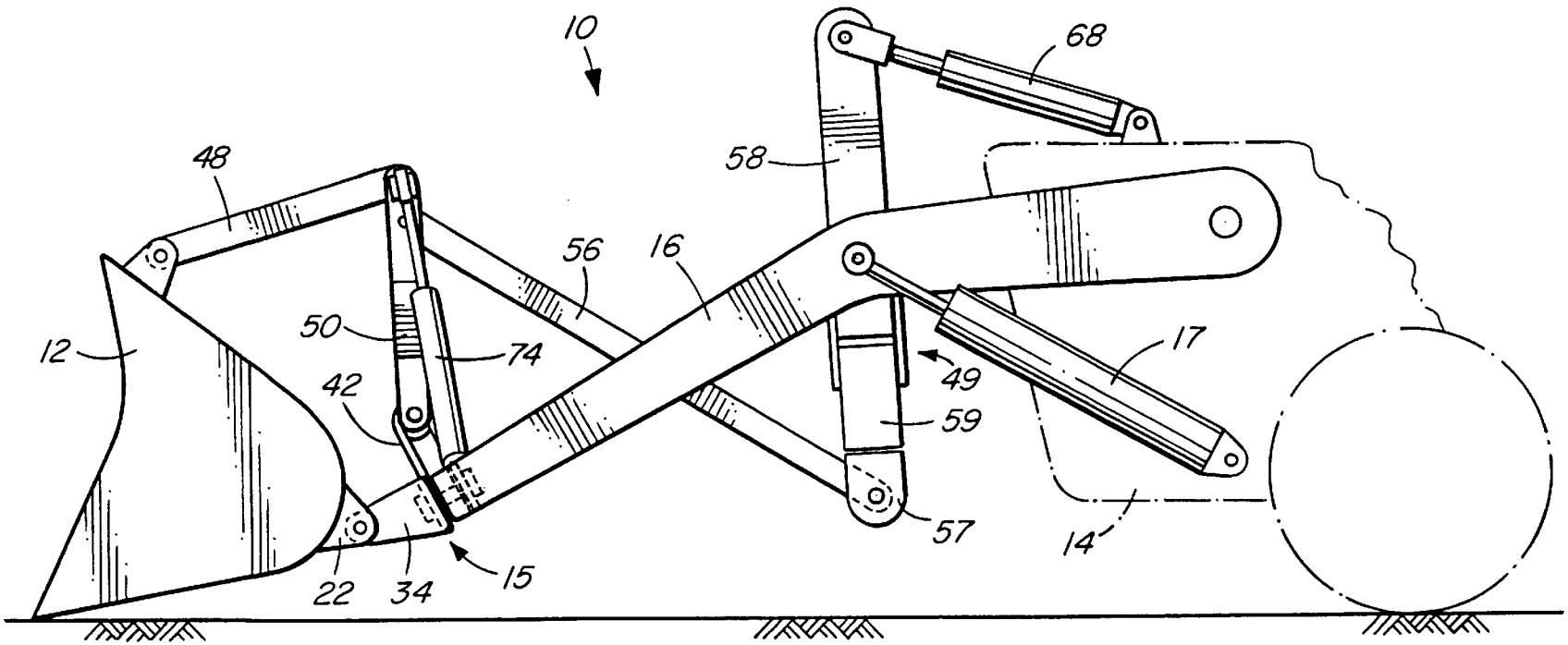
FIG. 1 is a side plan view of a bucket tilt mechanism embodying the invention secured to a typical front-end loader machine.

The present invention provides a bucket tilt mechanism (denoted generally 10) which can be fitted onto a conventional front-end loader machine 14, as shown in FIG. 1. Generally, bucket tilt mechanism 10 is comprised of a bucket 12, a bucket bracket 15, a pair of loader support arms 16 and 18 (not shown in FIG. 1, but see FIGS. 2 and 3), and a central arm linkage system 20, which comprises a number of individual sub-sections which will be described in detail hereafter. In a typical arrangement, loader support arms 16,18 are moved up and down by hydraulic lift cylinders 17.

Figure 2:
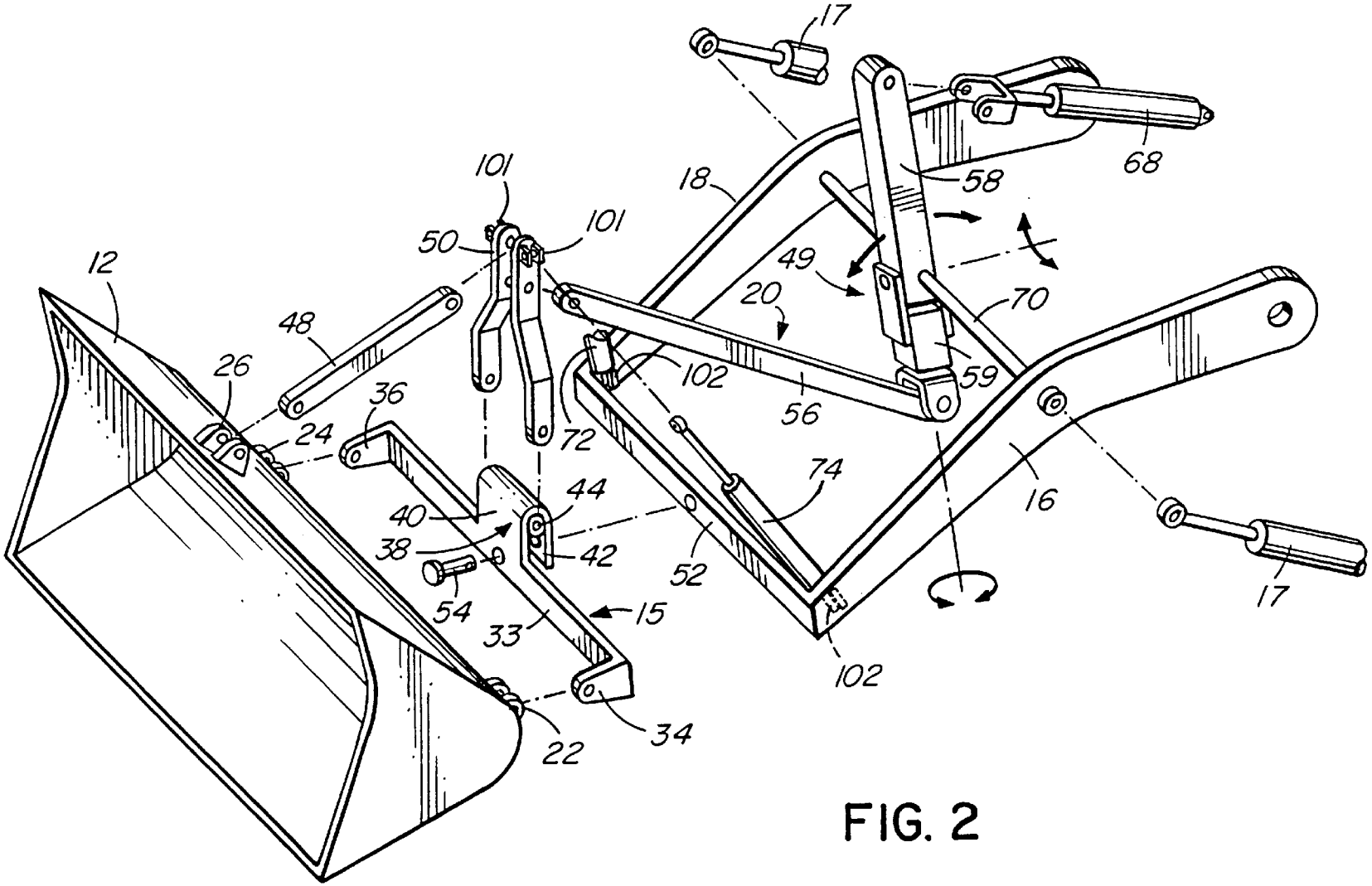
FIG. 2 is an exploded view of the bucket tilt mechanism of FIG. 1

The connection of bucket 12 to bucket bracket 15 is best illustrated in FIG. 2. Bucket 12 has two lower catch-plate structures 22 and 24, which provide locations for a pivotal connection of bucket 12 to bucket bracket 15 by pins (not shown). Catch-plate structures 22,24 are each comprised of a pair of similar flanges with corresponding apertures for the respective pins, but it will be appreciated that any arrangement that allows for the pivotal connection of bucket bracket 15 to bucket 12 will be suitable.

Bucket bracket 15 is comprised of a generally flat bar 33 that may extend substantially the width of bucket 12. Bar 33 is at least as wide as the distance between catch-plate structures 22,24. Flat bar 33 has two generally perpendicular flanges 34 and 36, one on each end. Flanges 34,36 extend perpendicularly to the longitudinal axis of flat bar 33 and towards bucket 12. Flanges 34,36 each have apertures which can be aligned with the apertures in catch-plate structures 22,24 to accept pins for holding the bracket flanges in place between the bucket flanges. Thus, bucket bracket 15 is pivotally attached to bucket 12.

Bucket bracket 15 further comprises a clevis 38 which occupies the central portion of flat bar 33. Clevis 38 has two clevis walls 40 and 42. Conveniently, clevis wall 40 is essentially an upward extension of flat bar 33. Clevis walls 40,42 each have an aperture for accepting a clevis pin to effect a pivot. Clevis walls 40,42 also support a tubular opening 44 at their upper-most ends. Tubular opening 44 allows for the use of a further pin (not shown) to pivotally attach a first linkage member 50 to clevis 38, First linkage member 50 is described in further detail below.

In the preferred embodiment, central arm linkage system 20 comprises a bucket linkage arm 48, a twistable arm 49 and an intermediate connecting arm 56. "Twistable", as used here, means that the arm has end portions rotatable relative one another about the arm's longitudinal axis.

Bucket linkage arm 48 is pivotally connected at its upper end to the top end of first linkage member 50. Bucket linkage arm 48 also pivotally connects to bucket 12 at a further catch-plate structure 26, which is similar to catch-plate structures 22,24 as described above.

First linkage member 50 may comprise two flat parallel bars having at least three corresponding pairs of coaxial apertures allowing for pivotal connections with pins. An upper pair of apertures allows for the pivotal connection with bucket linkage arm 48 described above, while a lower pair allows for a pivotal connection between first linkage member 50 and tubular opening 44 of clevis 38, as described above.

An intermediate pair of apertures forms a pivot point for a connection between first linkage member 50 and intermediate connecting arm 56. It will be appreciated that these connections may be achieved by positioning bucket linkage arm 48, intermediate connecting arm 56 and clevis 38 between the parallel bars of first linkage member 50 and inserting suitable pins through aligned apertures of the respective elements.

It will also be appreciated that in an alternative embodiment of the present invention intermediate connecting arm 56 could be directly attached to upper catch-plate structure 26 of bucket 12 to eliminate the need for bucket linkage arm 48 and first linkage member 50. Such an embodiment would also require alteration to the shape of bucket 12 to allow for an equivalent amount of lateral tilting of bucket 12.

Figure 3:
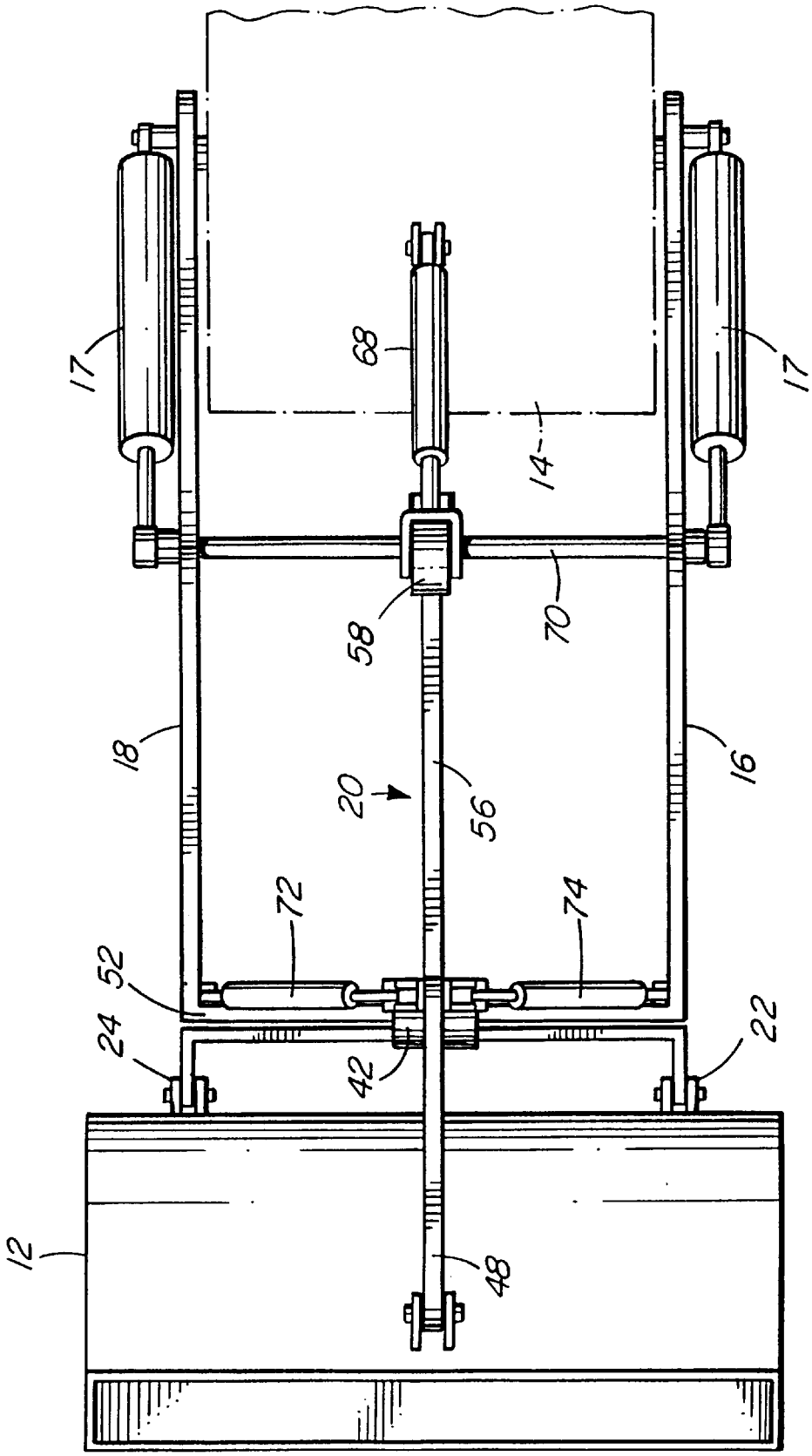
FIG. 3 is a top plan view of the bucket tilt mechanism.

As illustrated in FIG. 3, loader support arms 16,18 are substantially parallel to one another. A flat cross member 52 joins the front ends of support arms 16,18. Cross member 52 is generally transverse to the longitudinal axes of loader support arms 16,18. Cross member 52 may conveniently be substantially similar in width and length to flat bar 33 of bucket bracket 15. Furthermore, cross member 52 has an aperture that may be aligned with the apertures in clevis walls 40 and 42. When clevis 38 is mounted atop cross member 52, a pin 54 inserted through the aligned apertures provides a pivotal connection between bucket bracket 15 and cross member 52. This pivotal connection between cross member 52 and clevis 38 of bucket bracket 15 permits the lateral tilting of bucket bracket 15, and hence, bucket 12, relative cross member 52 and support arms 16,18. That is, bucket bracket 15 can pivot about pin 54 to effect the lateral tilting of bucket 12. It will be appreciated that wall 42 is not required for bracket 15 to be pivotally attached, but is desired to add stability.

The lateral tilting of bucket 12 is achieved through the actuation of one of a pair of hydraulic support arm cylinders 72,74. Support arm cylinders 72,74 may be attached at a first end to a bracket 101 on first linkage member 50 (shown in FIGS. 1 and 2) , or to one of clevis walls 40, 42 of bucket bracket 15, or directly to tubular opening 44 (not shown), and at a second end to a bracket 102 on one of loader support arms 16,18.

While one end of intermediate connecting arm 56 is pivotally connected to first linkage member 50, the other end is connected to a connecting bracket 57 on the bottom of twistable arm 49. Twistable arm 49 is shown in detail in FIG. 4.

In twistable arm 49, connecting bracket 57 is joined to side swing arm 59 by a universal joint 60, thereby allowing connecting bracket 57 to rotate around its axis. Side swing arm 59 is at its opposite end pivotally connected to actuating arm 58, which is in turn connected to a hydraulic central arm cylinder 68 at its opposite end. A shaft 70 may pass through actuating arm 58, connecting support arm 16 to support arm 18, intermediate the ends of support arms 16,18. This allows actuating arm 58, and central arm linkage system 20 more generally, to rotate about the longitudinal axis of shaft member 70. In this manner, shaft 70 stabilizes central arm linkage system 20.

Figure 4:
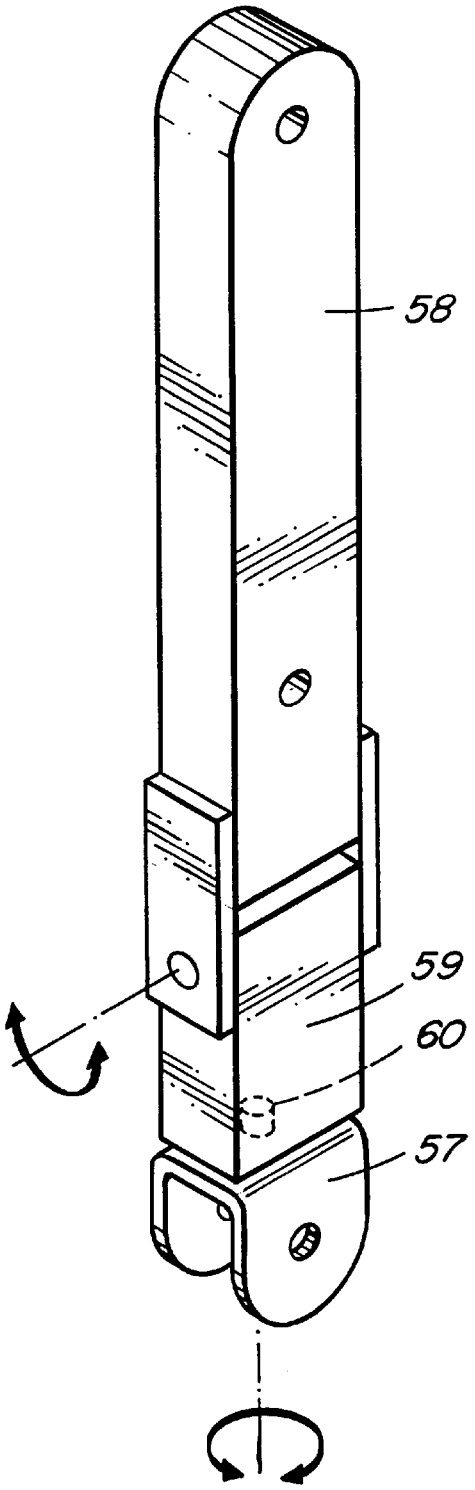
FIG. 4 is a perspective view of the twistable arm of the preferred embodiment of the invention.
Figure 5:
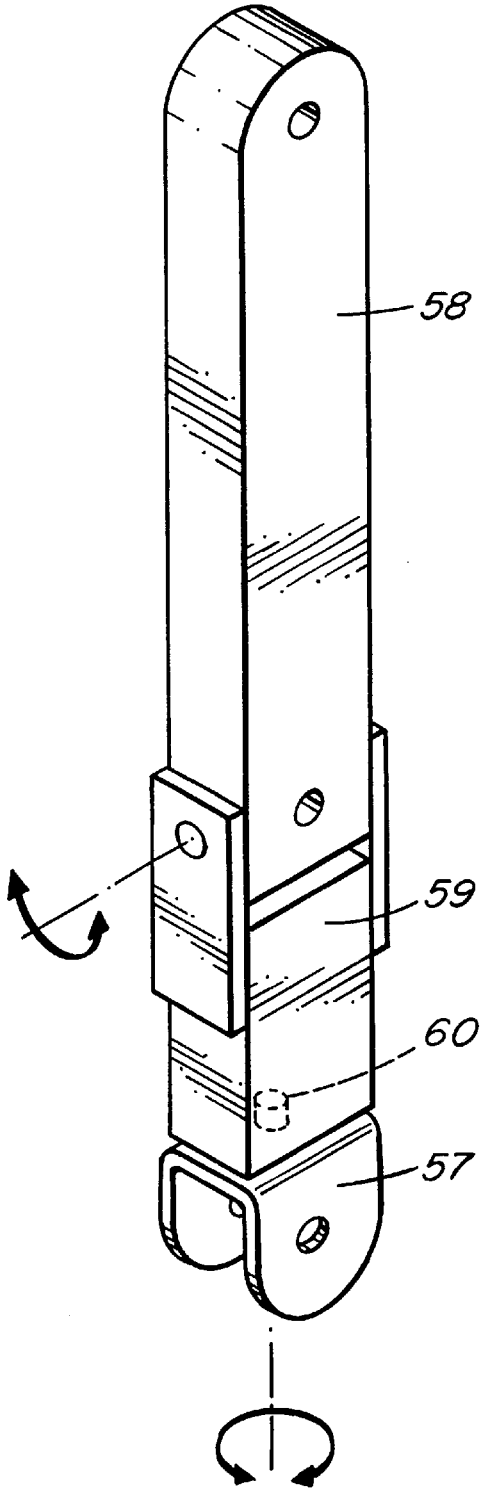
FIG. 5 is a perspective view of the twistable arm of a second embodiment of the invention.

Cylinder 68 actuates actuating arm 58 to cause up and down tilting of bucket 12. As shown in FIG. 4, the connection between swing arm 59 and actuating arm 58 may again be a clevis-type connection, with, in this example, the clevis arms formed by two rectangular plates welded onto opposing faces of actuating arm 58. Alternatively, as shown in FIG. 5, the clevis could be formed on swing arm 59, rather than actuating arm 58. In either case, a clevis pin joins the two arms, allowing swing arm 59 to swing in a pendular fashion relative the end of actuating arm 58.

When central arm cylinder 68 is actuated by the operator, the pivotal connections: (1) at catch-plate structures 22,24, 26,; (2) between bucket linkage arm 48 and first linkage member 50; (3) between first linkage member 50 and intermediate connecting arm 56; (4) between first linkage member 50 and clevis 38 through tubular opening 44; (5) between intermediate connecting arm 56 and U-shaped bracket 57 on twistable arm 49; and (6) between twistable arm and shaft 70 all contribute to allow the conventional up and down (i.e. frontward) tilting of bucket 12. It will be appreciated that as cylinders 72, 74 are actuated, the swinging action of swing arm 59, together with a slight rotation of arm 59 relative arm 56 allow bucket 12 to be laterally tilted as well.

In operation, when the operator actuates either or both of the support arm cylinders 72,74 (causing one cylinder shaft to lengthen, while the other shortens), bucket bracket 15, being connected to support arm cylinders 72,74, preferably by first linkage member 50, tends to rotate relative cross member 52, which is fixed horizontally relative loader 14. As described above, the entirety of central arm linkage system 20 follows along with bucket bracket 15, and does not bind because of the relative twisting motion allowed by the connected elements of twisting arm 49. Since bucket 12 is laterally fixedly connected to bucket bracket 15, bucket 12 rotates, or laterally "tilts", along with bucket bracket 15, relative cross bar 52, loader support arms 16,18 and more generally, front-end loader machine 14.

As will be apparent to those skilled in the art in the light of the foregoing disclosure, many alterations and modifications are possible in the practice of this invention without departing from the spirit or scope thereof. For example, it will be apparent to many skilled in the art that twistable arm 49 could comprise a ball-joint. Although this arrangement has its own disadvantages, it does eliminate the need for some of the pivoting elements of arm 49.

Accordingly, the scope of the invention is to be construed in accordance with the substance defined by the following claims.

What is claimed is:

1. A tilting loader bucket mechanism for attachment to a loader having support arms, said mechanism comprising:

(a) a loader bucket;

(b) a bracket pivotally connected to said loader bucket and pivotally attached to a member connecting said support arms of said loader;

(c) a central linkage arm having a central longitudinal axis, said central linkage arm pivotally attached to said loader bucket at a first end and attached at a second end to a hydraulic lift cylinder attached to said loader, said central linkage arm reciprocable between a first centrally-aligned position, a first tilted position and a second tilted position;

(d) means for attaching an intermediate portion of said central linkage arm to said bracket; and (e) means for coordinating non-axial movement of said central linkage arm between said first tilted position and said second tilted position.

2. The tilting loader bucket mechanism as claimed in claim 1 wherein said central linkage arm comprises a bucket linkage arm attached at a first end to said loader bucket, a twistable arm attached to said hydraulic lift cylinder, said twistable arm having end portions rotatable relative one another about said twistable arm's longitudinal axis, and an intermediate connecting arm connecting said bucket linkage arm and said twistable arm.

3. The tilting loader bucket mechanism as claimed in claim 2 wherein said means for attaching an intermediate portion of said central linkage arm to said bracket comprises a pair of upstanding members connected at one end to said central linkage arm, and at another end connected pivotally to said bracket, said bucket linkage arm and said intermediate connecting arm both pivotally attached to each of said upstanding members.

4. The tilting loader bucket mechanism as claimed in claim 3 wherein said means for coordinating non-axial movement of said central arm between said first tilted position and said second tilted position comprises a first hydraulic cylinder attached between one of said loader support arms and said bracket and a second hydraulic cylinder attached between the other of said loader support arms and said bracket, wherein extension of one of said cylinders, and corresponding retraction of the other of said cylinders, actuates non-axial movement of said central linkage arm.

5. The tilting loader bucket mechanism as claimed in claim 3 wherein said means for coordinating non-axial movement of said central arm between said first tilted position and said second tilted position comprises a first hydraulic cylinder attached between one of said loader support arms and one of said upstanding members, and a second hydraulic cylinder attached between the other of said loader support arms and the other of said upstanding members, wherein extension of one of said cylinders, and corresponding retraction of the other of said cylinders, actuates non-axial movement of said central linkage arm.

6. The tilting loader bucket mechanism as claimed in claim 5 wherein said bucket bracket comprises a generally flat bar having flanges for attachment to said loader bucket and a clevis occupying a central portion of said bar, said clevis overhanging said member connecting said supports arms of said loader and pivotally attached thereto.

7. A tilting loader bucket mechanism for attachment to a loader having support arms, said mechanism comprising:

(a) a loader bucket;

(b) a bracket pivotally connected to said loader bucket, said bucket bracket comprising a generally flat bar having flanges for attachment to said loader bucket and a clevis occupying a central portion of said bar;

(c) a member connecting said support arms of said loader, said clevis overhanging said member and pivotally attached thereto by a pivotal connection;

(d) a central linkage arm, said central linkage arm comprising a bucket linkage arm pivotally connected to said loader bucket at one end, and pivotally connected to said bucket bracket an another end, an intermediate connecting arm pivotally connected to said bucket bracket at one end and pivotally connected at another end to an end of a twistable arm, said twistable arm connected at another end to a hydraulic lift cylinder connected to said loader;

(e) a first hydraulic cylinder attached between one of said loader support arms and said bucket bracket and a second hydraulic cylinder attached between the other of said loader support arms and said bucket bracket, wherein extension of one of said cylinders, and corresponding retraction of the other of said cylinders actuates non-axial movement of said central linkage arm about said pivotal connection between said bucket bracket and said member connecting said support arms.

8. The tilting loader bucket mechanism as claimed in claim 7 wherein said twistable arm comprises an actuating arm connected to said hydraulic lift cylinder at one end, a swing arm pivotally connected to the other end of said actuating arm, and an arm-connecting bracket attached to said swing arm by a universal joint.

9. The tilting loader bucket mechanism as claimed in claim 7 wherein said twistable arm comprises an actuating arm connected to said hydraulic lift cylinder at one end and an arm-connecting bracket attached at another end of said actuating arm with a ball joint.

* * * * *